US011172319B2

(12) United States Patent
Goshen et al.

(10) Patent No.: US 11,172,319 B2
(45) Date of Patent: Nov. 9, 2021

(54) SYSTEM AND METHOD FOR VOLUMETRIC SOUND GENERATION

(71) Applicant: InSoundz Ltd., Tel Aviv (IL)

(72) Inventors: Tomer Goshen, Tel Aviv (IL); Emil Winebrand, Petach Tikva (IL); Tzahi Zilbershtein, Holon (IL)

(73) Assignee: Insoundz Ltd., Tel Aviv (IL)

( * ) Notice: Subject to any disclaimer, the term of this patent is extended or adjusted under 35 U.S.C. 154(b) by 441 days.

(21) Appl. No.: 16/229,840

(22) Filed: Dec. 21, 2018

(65) Prior Publication Data

US 2019/0200157 A1 Jun. 27, 2019

Related U.S. Application Data

(60) Provisional application No. 62/608,580, filed on Dec. 21, 2017.

(51) Int. Cl.

| | |
|---|---|
| ***H04R 5/02*** | (2006.01) |
| ***H04S 7/00*** | (2006.01) |
| ***H04R 5/027*** | (2006.01) |
| ***H04R 5/04*** | (2006.01) |
| ***H04R 1/40*** | (2006.01) |
| *H04S 3/00* | (2006.01) |

(52) U.S. Cl.

CPC ..... *H04S 7/303* (2013.01); *H04R 1/406* (2013.01); *H04R 5/027* (2013.01); *H04R 5/04* (2013.01); *H04R 2201/401* (2013.01); *H04R 2430/21* (2013.01); *H04R 2430/25* (2013.01); *H04S 3/008* (2013.01); *H04S 2400/11* (2013.01); *H04S 2400/15* (2013.01)

(58) Field of Classification Search

CPC ..... H04R 5/02

See application file for complete search history.

(56) References Cited

U.S. PATENT DOCUMENTS

| | | | | |
|---|---|---|---|---|
| 4,741,038 | A | 4/1988 | Elko et al. | |
| 5,335,011 | A | 8/1994 | Addeo et al. | |
| 6,449,593 | B1 | 9/2002 | Valve | |
| 6,707,910 | B1 | 3/2004 | Valve et al. | |
| 6,836,243 | B2 | 12/2004 | Kajala et al. | |
| 7,706,549 | B2 | 4/2010 | Zhang et al. | |
| 7,986,794 | B2 | 7/2011 | Zhang | |
| 9,240,213 | B2 | 1/2016 | Gerstlberger et al. | |
| 9,508,012 | B2 | 11/2016 | Oguchi et al. | |
| 9,509,968 | B2 | 11/2016 | Zimmermann et al. | |
| 2005/0080616 | A1* | 4/2005 | Leung | H04R 5/027 704/200.1 |
| 2013/0034241 | A1 | 2/2013 | Pandey et al. | |
| 2013/0051577 | A1 | 2/2013 | Morcelli et al. | |
| 2013/0216046 | A1 | 8/2013 | Ikeda et al. | |
| 2014/0029761 | A1 | 1/2014 | Maenpaa et al. | |
| 2016/0057539 | A1* | 2/2016 | Bai | H04S 7/30 381/26 |

* cited by examiner

*Primary Examiner* — Olisa Anwah

(74) *Attorney, Agent, or Firm* — M&B IP Analysts, LLC

(57) ABSTRACT

A system and method for volumetric sounds generation. The method includes: generating multiple sounds beams from a plurality of microphones within a three-dimensional space; capturing multiple sound signals generated by multiple sounds sources located within the three-dimensional space, where the multiple sound signals are captured based on the multiple sound beams; and, generating a pattern for each of the multiple sound sources.

19 Claims, 3 Drawing Sheets

SYSTEM AND METHOD FOR VOLUMETRIC SOUND GENERATION

CROSS-REFERENCE TO RELATED APPLICATIONS

This application claims the benefit of U.S. Provisional Application No. 62/608,580 filed on Dec. 21, 2017, the contents of which are hereby incorporated by reference.

TECHNICAL FIELD

The present disclosure relates generally to sound capturing systems and, more specifically, to systems for capturing volumetric sounds using a plurality of microphones and projecting the generated volumetric sounds.

BACKGROUND

Audio is an integral part of multimedia content, whether viewed on a television, a personal computing device, a projector, or any other of a variety of viewing means. The importance of audio becomes increasingly significant when the content includes multiple sub-events occurring concurrently. For example, while viewing a sporting event, many viewers appreciate the ability to listen to conversations occurring between players, instructions given by a coach, exchanges of words between a player and an umpire, and similar verbal communications, simultaneously with the audio of the event itself.

The obstacle with providing such simultaneous concurrent audio content is that currently available sound capturing devices, i.e., microphones, are unable to practically adjust to dynamic and intensive environments, such as, e.g., a sporting event. Many current audio systems struggle to track a single player or coach as that person moves through space, and falls short of adequately tracking multiple concurrent audio events.

Commonly, a large microphone boom is used to move the microphone around in an attempt to capture the desired sound. This issue is becoming significantly more notable due to the advent of high-definition (HD) television that provides high-quality images on the screen with disproportionately low sound quality.

A demand for lifelike simulation is rapidly increasing, particularly for augmented and virtual reality experiences. Although the current visual offerings have made significant progress, the corresponding audio is left behind. One of the main reasons for this is that simulating an audio experience of a moving sound source requires overcoming various challenges relating to six degrees of separation (6DoF).

It would therefore be advantageous to provide a solution that would overcome the challenges noted above.

SUMMARY

A summary of several example embodiments of the disclosure follows. This summary is provided for the convenience of the reader to provide a basic understanding of such embodiments and does not wholly define the breadth of the disclosure. This summary is not an extensive overview of all contemplated embodiments, and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "certain embodiments" may be used herein to refer to a single embodiment or multiple embodiments of the disclosure.

Certain embodiments disclosed herein include a method for volumetric sounds generation, including: generating multiple sounds beams from a plurality of microphones within a three-dimensional space; capturing multiple sound signals generated by multiple sounds sources located within the three-dimensional space, where the multiple sound signals are captured based on the multiple sound beams; and, generating a pattern for each of the multiple sound sources.

Certain embodiments disclosed herein also include a non-transitory computer readable medium having stored thereon instructions for causing a processing circuitry to perform a process, the process including: generating multiple sounds beams from a plurality of microphones within a three-dimensional space; capturing multiple sound signals generated by multiple sounds sources located within the three-dimensional space, where the multiple sound signals are captured based on the multiple sound beams; and, generating a pattern for each of the multiple sound sources.

Certain embodiments disclosed herein also include a system for volumetric sounds generation, including: a processing circuitry; and a memory, the memory containing instructions that, when executed by the processing circuitry, configure the system to: generate multiple sounds beams from a plurality of microphones within a three-dimensional space; capture multiple sound signals generated by multiple sounds sources located within the three-dimensional space, where the multiple sound signals are captured based on the multiple sound beams; and, generate a pattern for each of the multiple sound sources.

BRIEF DESCRIPTION OF THE DRAWINGS

The subject matter disclosed herein is particularly pointed out and distinctly claimed in the claims at the conclusion of the specification. The foregoing and other objects, features, and advantages of the disclosed embodiments will be apparent from the following detailed description taken in conjunction with the accompanying drawings.

DETAILED DESCRIPTION

Figure 1:
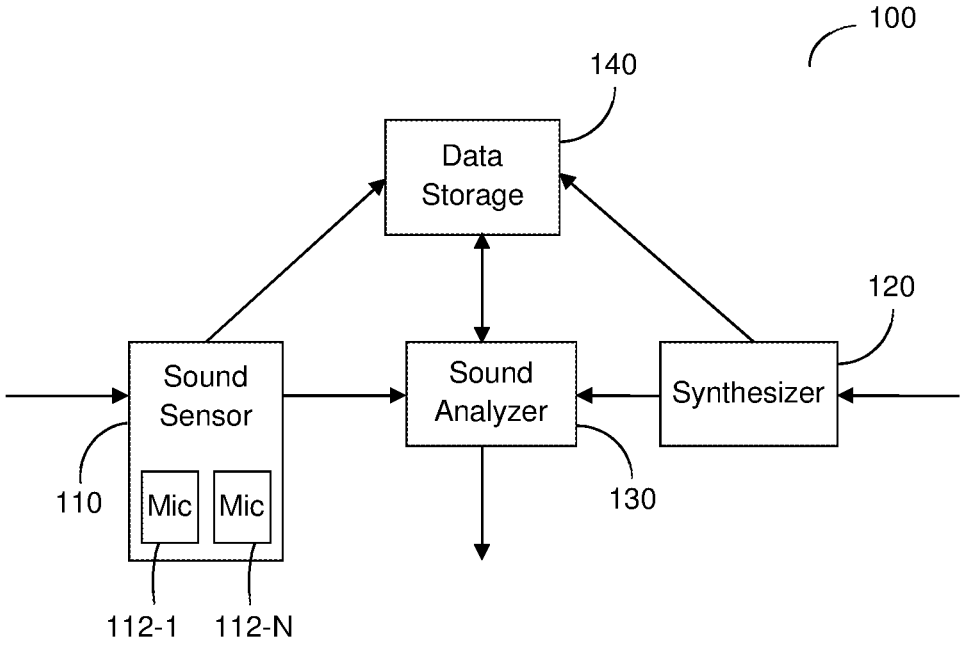
FIG. 1 is a block diagram of a system for generating volumetric sounds according to an embodiment.

It is important to note that the embodiments disclosed herein are only examples of the many advantageous uses of the innovative teachings herein. In general, statements made in the specification of the present application do not necessarily limit any of the various claimed embodiments. Moreover, some statements may apply to some inventive features but not to others. In general, unless otherwise indicated, singular elements may be in plural and vice versa with no loss of generality. In the drawings, like numerals refer to like parts through several views.

The various disclosed embodiments include a method and sound processing system for generating volumetric sounds based on a plurality of sound signals generated by a plurality of sounds sources in a three-dimensional space. In an example embodiment, the system includes a plurality of microphones located in proximity to the three-dimensional space. The microphones may be positioned in one or more microphone arrays. The microphones are configured to generate a plurality of receptive sound beams. Responsive to the sound beams, a plurality of sound signals generated within the three-dimensional space by each of the plurality of sounds sources are captured. The system is then configured to generate a pattern for each sound source. The pattern indicates directional coordinates of the sound source, volume characteristics, angles, and the like. Based on the patterns, the system is configured to generate volumetric sounds with respect to the various sounds signals. According to an embodiment, the volumetric sounds enable simulation of audio experience in certain locations in the space.

FIG. 1 is an example block diagram of a sound processing system 100 designed according to an embodiment. A sound sensor 110 includes a plurality of microphones 112-1 to 112-N, where N is an integer equal to or greater than 2, configured to capture multiple sound signals within a predetermined space. The plurality of microphones may be configured in one or more microphone arrays. The sound signals may be captured from multiple non-manipulated sound beams generated by the sound sensor 110 within the predetermined space.

In one embodiment, the sound processing system 100 may further include a storage in the form of a data storage unit 140 or a database (not shown) for storing, for example, sound signals, patterns, metadata, information from filters and/or other information captured by the sound sensor 110. The data storage 140 may be located on premise, or may be stored remotely, e.g., within a networked cloud storage system.

The filters employed may include circuits working within a predetermined audio frequency range that are used to process the sound signals captured by the sound sensor 110. The filters may be preconfigured, or may be dynamically adjusted with respect to the received metadata.

In various embodiments, one or more of the sound sensors 110, a beam synthesizer 120, and a sound analyzer 130 may be coupled to the data storage unit 140. In another embodiment, the sound processing system 100 may further include a controller (not shown) connected to the beam synthesizer 120. The controller may further include a user interface that allows tracking of a sound source as further described herein below.

According to an embodiment, multiple sound beams are generated within a predetermined space, for example, a sports field or court, an avenue, a show and the like. Responsive thereto, multiple sound signals generated within the three-dimensional space by each of multiple sound sources located therein are captured. Thereafter, a pattern is generated for each sound source based on the captured sound signals. The generation of the pattern may include calculation of a sample of the pattern for each sound signal corresponding to the associated sound beam. The generated samples may be interpolated and based on the interpolation, a three-dimensional pattern of each source can be generated.

According to an embodiment, metadata associated with each sound signal may further be captured by the sound sensor 110. The synthesizer 120 is configured to project the captured sound signals onto a grid corresponding to the predetermined space. The grid may be adaptive through time and configured to enable characterization of the captured sound signals, as further described herein below. According to an embodiment, the grid may be used for identification of interest points within the predetermined space.

As a non-limiting example, upon identification of multiple sound signals captured at a certain portion of the grid, such a portion may be determined as an interest point. As an example of this embodiment, in a basketball game, an interest point may be determined to be the area near the basket. In an embodiment, the interest point may include an area where sound interaction is above a predefined threshold, e.g., if a conversation or single speaker is speaking above 70 decibels.

Following the projection of the sound signals on the grid, the sound signals are analyzed by the sound analyzer 130. The analysis may include one or more beamforming techniques. In an embodiment, the analysis is performed in a time domain. According to this embodiment, an extracted filter is applied to each sound signal. In an embodiment, the filter may be applied by a synthesizer 120. The filtered signals may be summed to a single signal by, e.g., the synthesizer 120.

In another embodiment, the analysis is performed in the frequency domain in which the received sound signal is first segmented. In that embodiment, each of the segments is transformed by, for example, a one-dimensional fast Fourier transform (FFT) or any other wavelet decomposition transformation.

The transformed segments are multiplied by weighted factors. The output is summed for each decomposition element and transformed by an inverse one-dimensional fast Fourier transform (IFFT) or any other wavelet reconstruction transformation.

In an embodiment, one or more weighted factors are generated. The weighted factors are generated by a generalized side lobe canceller (GSC) algorithm. According to this embodiment, it is presumed that the direction of the sources from which sounds are received, the direction of the desired signal, and the magnitudes of those sources are known. The weighted factors are generated by determining a unit gain in the direction of the desired signal source while minimizing the overall root mean square (RMS) noise power.

According to another embodiment, the weighted factors are generated by an adaptive method in which the noise strength impinging each microphone and the noise correlation between the microphones are tracked. In this embodiment, the direction of the desired signal source is received as an input. Based on the received parameters, the expectancy of the output noise is minimized while maintaining a unity gain in the direction of the desired signal. This process is performed separately for each sound interval.

When the disclosed embodiment is implemented to capture specific voices (sound signals) produced by an individual, the microphone array is configured to mute sounds that are generated by side lobes, thereby isolating the specific sound generated by the individual. This creates a sound beam, which allows a system to capture voices only existing within the sound beam itself, preferably with emphasis on the voice of the desired individual. In one embodiment the system is capable of identifying nearby sources of unwanted noise, and of muting such sources.

Beamforming techniques, sound signal filters, and weighted factors are described further in the U.S. Pat. No. 9,788,108, assigned to the common assignee, which is hereby incorporated by reference.

Based on the captured sound signals and the patterns generated, multiple volumetric sounds are generated. The volumetric sounds can be used to simulate an audio experience from different locations within the three-dimensional space, i.e., six degrees of freedom therein.

According to an embodiment, the patterns generated may be represented in higher order ambisonic (HOA) decomposition. HOA is a full-sphere surround sound technique wherein in addition to the horizontal plane, this technique incorporates sound sources above and below a sound capturing unit. The capture sound signals are transformed into HOA coefficients, and thus could be delivered in compact representation to an end user. The sound source HOA representation could be transferred as an object based, i.e., HOA coefficient for each object or scene, or as a combination thereof.

Figure 2:
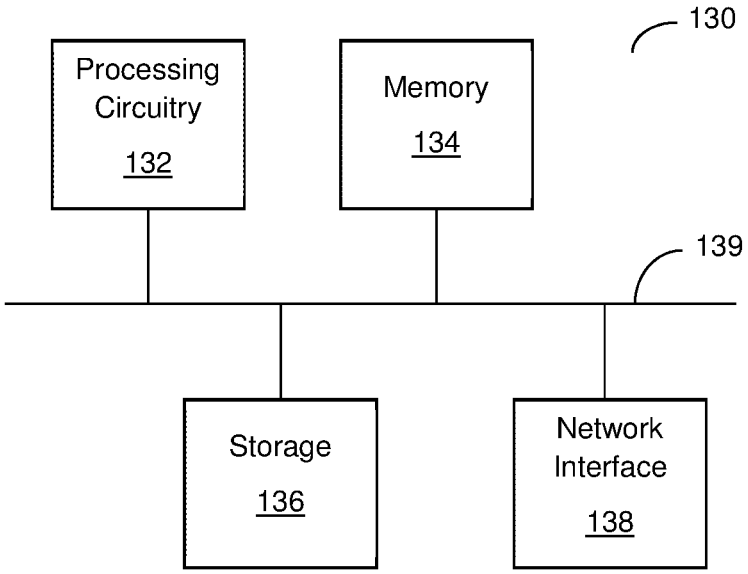
FIG. 2 is a block diagram of the sound analyzer according to an embodiment.

FIG. 2 is an example block diagram of the sound analyzer 130 according to an embodiment. The sound analyzer 130 includes a processing circuitry 132 coupled to a memory 134, a storage 136, and a network interface 138. In an embodiment, the components of the sound analyzer 130 may be communicatively connected via a bus 139.

The processing circuitry 132 may be realized as one or more hardware logic components and circuits. For example, and without limitation, illustrative types of hardware logic components that can be used include field programmable gate arrays (FPGAs), application-specific integrated circuits (ASICs), application-specific standard products (ASSPs), system-on-a-chip systems (SOCs), general-purpose microprocessors, microcontrollers, digital signal processors (DSPs), and the like, or any other hardware logic components that can perform calculations or other manipulations of information.

In another embodiment, the memory 134 is configured to store software. Software shall be construed broadly to mean any type of instructions, whether referred to as software, firmware, middleware, microcode, hardware description language, or otherwise. Instructions may include code (e.g., in source code format, binary code format, executable code format, or any other suitable format of code). The instructions cause the processing circuitry 132 to perform the sound analysis described herein.

The storage 136 may be magnetic storage, optical storage, and the like, and may be realized, for example, as flash memory or other memory technology, hard-drives, SSD, or any other medium which can be used to store the desired information. The storage 136 may store one or more sound signals, one or more grids associated with an area, interest points and the like.

The network interface 138 is configured to allow the sound analyzer 130 to communicate with the sound sensor 110, the data storage 140, and the beam synthesizer 120. The network interface 138 may include, but is not limited to, a wired interface (e.g., an Ethernet port) or a wireless port (e.g., an 802.11 compliant WiFi card) configured to connect to a network (not shown).

Figure 3:
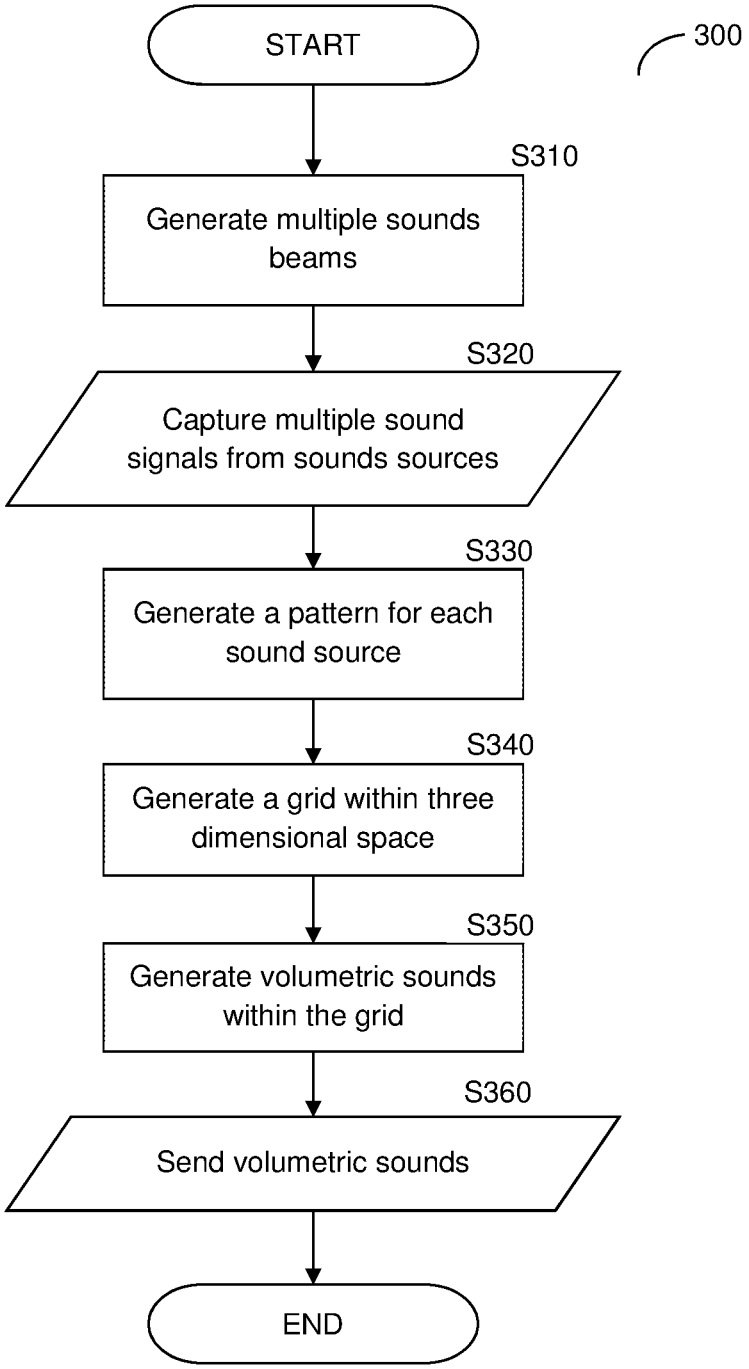
FIG. 3 is a flowchart illustrating a method for generation and delivery of volumetric sounds according to an embodiment.

FIG. 3 is an example flowchart 300 illustrating a method for generating volumetric sounds according to an embodiment.

At S310, multiple sound beams are generated within a three-dimensional space. The sounds beams may be generated by a plurality of microphones configured in one or more microphone arrays. The microphones in the microphone arrays may be positioned or otherwise arranged in a variety of polygons in order to achieve an appropriate coverage of the multiple sound beams. In yet another embodiment, the microphones in the microphone array are arranged on curved lines. Furthermore, the microphones in the microphone array may be arranged in a three-dimensional shape, for example on a three dimensional sphere or a three dimensional object formed of a plurality of hexagons. The microphone arrays may be positioned or otherwise arranged at a predetermined distance from each other to achieve an appropriate coverage of the multiple sound beams. For example, two microphone arrays can be positioned under respective baskets of opposing teams in a basketball court.

At S320, multiple sound signals generated within the three-dimensional space are captured based on the sound beams. The sounds signals are generated by one or more sound sources located within the three-dimensional space. Sound sources may include, but are not limited to, individuals, groups of individuals, large crowds, ambient noise, and the like.

At S330, a pattern is generated for each sound source based on the sound signals generated therefrom. The pattern is indicative of characteristics associated with the sound source, for example, directional, volume, location coordinates within the three-dimensional space, and the like. The generation of the patterns may include calculation of a sample of the pattern for each sound signal corresponding to an associated sound beam. The generated samples may be interpolated and, based on the interpolation, a three-dimensional pattern of each source can be generated. In an embodiment, the generated patterns may be represented by higher order ambisonic (HOA) decomposition.

At S340, a grid is generated within the three-dimensional space. The grid may be generated based on the captured multiple sound signals, and may represent spatial positioning of each of the multiple sound signals within a single space. Thus, each sound signal may be placed on the grid relative to each other sound signal, in order to be reproduced in a virtual three-dimensional space.

At S350, volumetric sounds are generated based on the sound signals and patterns. The generation of volumetric sounds includes simulating sound sources within a three-dimensional space so as to virtually emulate an auditory experience. The generation may include placing sound sources at various locations in a virtual space so that a user will hear a realistic auditory experience rather than sound from a single source. As a non-limiting example, the volumetric sounds enable simulating the audio experience of a viewer attending a live basketball game.

At optional S360, the volumetric sounds are provided to one or more user nodes. User nodes may include user devices, such as smartphones, personal computers, tablets, virtual reality headsets, surround sound audio system, and the like.

Figure 4:
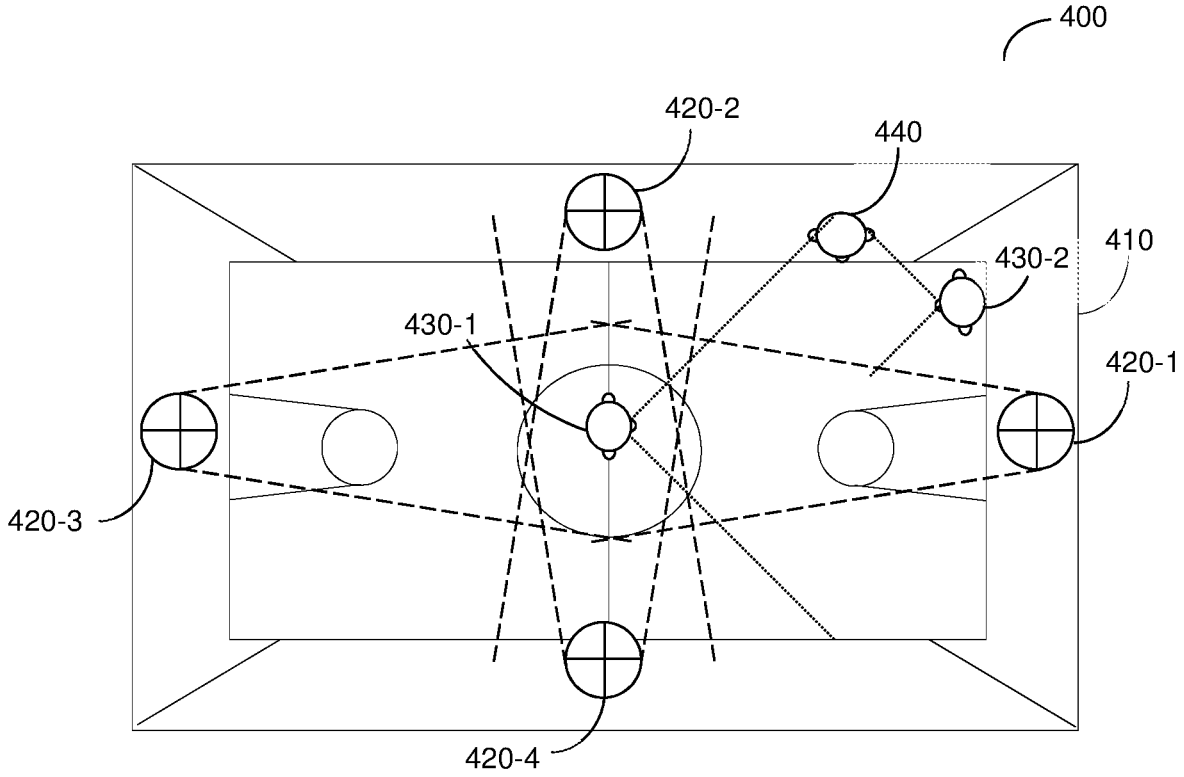
FIG. 4 is a schematic diagram of a simulation of generating and sending volumetric sounds according to an embodiment.

FIG. 4 depicts an exemplary simulation 400 of generating and sending volumetric sounds in a basketball court 410 according to some disclosed embodiments. A plurality of microphone arrays 420-1 through 420-4 are located in proximity to the basketball court 410. Each microphone array is configured to generated sounds beams in order to capture sounds signals within the basketball court 410. According to this embodiment, sounds sources, e.g., players 430-1 and 430-2 are located on the basketball court 410. The sounds sources 430 continuously generating sound signals that are captured by the microphone arrays 420 responsive to the sound beams.

A pattern is generated for each sound source 430. The pattern is computed continuously to determine whether each sound source 430 is standing still or in movement. Based on the pattern, the system 100 can generate the perception of the audio experience at different locations within the three-dimensional space. According to an embodiment, the system 100 can simulate the audio experience of a viewer 440 sitting in proximity to the basketball court 410. The audio experience is delivered by the system 100 to a user device such as, for example a virtual reality headset or surround sound audio system. The volume and direction provided to each side of the headset may be customized separately in order to provide an optimal experience.

The various embodiments disclosed herein can be implemented as hardware, firmware, software, or any combination thereof. Moreover, the software is preferably implemented as an application program tangibly embodied on a program storage unit or computer readable medium consisting of parts, or of certain devices and/or a combination of devices. The application program may be uploaded to, and executed by, a machine comprising any suitable architecture. Preferably, the machine is implemented on a computer platform having hardware such as one or more central processing units ("CPUs"), a memory, and input/output interfaces. The computer platform may also include an operating system and microinstruction code. The various processes and functions described herein may be either part of the microinstruction code or part of the application program, or any combination thereof, which may be executed by a CPU, whether or not such a computer or processor is explicitly shown. In addition, various other peripheral units may be connected to the computer platform such as an additional data storage unit and a printing unit. Furthermore, a non-transitory computer readable medium is any computer readable medium except for a transitory propagating signal.

As used herein, the phrase "at least one of" followed by a listing of items means that any of the listed items can be utilized individually, or any combination of two or more of the listed items can be utilized. For example, if a system is described as including "at least one of A, B, and C," the system can include A alone; B alone; C alone; A and B in combination; B and C in combination; A and C in combination; or A, B, and C in combination.

All examples and conditional language recited herein are intended for pedagogical purposes to aid the reader in understanding the principles of the disclosed embodiment and the concepts contributed by the inventor to furthering the art, and are to be construed as being without limitation to such specifically recited examples and conditions. Moreover, all statements herein reciting principles, aspects, and embodiments of the disclosed embodiments, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. A method for volumetric sounds generation, comprising:

generating multiple sounds beams from a plurality of microphones within a three-dimensional space;

capturing multiple sound signals generated by multiple sounds sources located within the three-dimensional space, where the multiple sound signals are captured based on the multiple sound beams; and, generating a pattern for each of the multiple sound sources, wherein generating the pattern further comprises:

computing a sample of the pattern for each of the multiple sound signals;

interpolating the samples; and generating a three-dimensional pattern for each of the multiple sound sources based on the interpolation.

2. The method of claim 1, further comprising:

generating a grid based on the three-dimensional space and the captured multiple sounds signals.

3. The method of claim 2, further comprising:

projecting the captured multiple sound signals onto the grid corresponding to the three-dimensional space.

4. The method of claim 1, further comprising:

generating volumetric sounds based on the multiple sounds signals and the generated pattern.

5. The method of claim 4, further comprising:

sending the volumetric sounds to a user device.

6. The method of claim 4, wherein the volumetric sounds are configured to simulate an audio experience from different locations within the three-dimensional space.

7. The method of claim 1, wherein the captured multiple sound signals further include metadata associated therewith.

8. The method of claim 1, wherein the multiple sound signals are further analyzed, and wherein the analysis is performed in at least one of: the frequency domain and the time domain.

9. The method of claim 8, wherein the analysis includes transforming the multiple sound signals with a wavelet decomposition transformation.

10. A non-transitory computer readable medium having stored thereon instructions for causing a processing circuitry to perform a process, the process comprising:

generating multiple sounds beams from a plurality of microphones within a three-dimensional space;

capturing multiple sound signals generated by multiple sounds sources located within the three-dimensional space, where the multiple sound signals are captured based on the multiple sound beams; and, generating a pattern for each of the multiple sound sources, wherein generating the pattern further comprises:

computing a sample of the pattern for each of the multiple sound signals;

interpolating the samples; and generating a three-dimensional pattern for each of the multiple sound sources based on the interpolation.

11. A system for volumetric sounds generation, comprising:

a processing circuitry; and a memory, the memory containing instructions that, when executed by the processing circuitry, configure the system to:

generate multiple sounds beams from a plurality of microphones within a three-dimensional space;

capture multiple sound signals generated by multiple sounds sources located within the three-dimensional space, where the multiple sound signals are captured based on the multiple sound beams; and, generate a pattern for each of the multiple sound sources, wherein the system is further configured to:

compute a sample of the pattern for each of the multiple sound signals;

interpolate the samples; and generate a three-dimensional pattern for each of the multiple sound sources based on the interpolation.

12. The system of claim 11, wherein the system is further configured to:

generate a grid based on the three-dimensional space and the captured multiple sounds signals.

13. The system of claim 12, wherein the system is further configured to:

project the captured multiple sound signals onto the grid corresponding to the three-dimensional space.

14. The system of claim 11, wherein the system is further configured to:

generate volumetric sounds based on the multiple sounds signals and the generated pattern.

15. The system of claim 14, wherein the system is further configured to:

send the volumetric sounds to a user device.

16. The system of claim 14, wherein the volumetric sounds are configured to simulate an audio experience from different locations within the three-dimensional space.

17. The system of claim 11, wherein the captured multiple sound signals further include metadata associated therewith.

18. The system of claim 11, wherein the multiple sound signals are further analyzed, and wherein the analysis is performed in at least one of: the frequency domain and the time domain.

19. The method of claim 18, wherein the analysis includes transforming the multiple sound signals with a wavelet decomposition transformation.

* * * * *